United States Patent [19]

Oki et al.

[11] Patent Number: 4,560,298

[45] Date of Patent: Dec. 24, 1985

[54] OPENING AND CLOSING DEVICE FOR RETRACTABLE NIB FOUNTAIN PEN

[75] Inventors: Takeo Oki; Katsutoshi Ichikawa, both of Kanagawa, Japan

[73] Assignee: Pilot Man-Nen-Hitsu Kabushiki Kaisha, Tokyo, Japan

[21] Appl. No.: 441,011

[22] Filed: Nov. 12, 1982

[30] Foreign Application Priority Data

Nov. 20, 1981 [JP] Japan ..... 56-186634

[51] Int. Cl.[4] ..... B43K 9/00; B43K 5/16

[52] U.S. Cl. ..... 401/107; 401/108

[58] Field of Search ..... 401/107, 108

[56] References Cited

U.S. PATENT DOCUMENTS

| | | | |
|---|---|---|---|
| 1,809,416 | 6/1931 | Liddell | 401/107 |
| 2,092,459 | 9/1937 | Kutter | 401/108 X |
| 2,957,452 | 10/1960 | Brannon | 401/108 |
| 3,292,593 | 12/1966 | Furuya | 401/107 |
| 3,362,778 | 1/1968 | Pavese | 401/107 |
| 3,399,946 | 9/1968 | Tokorozawa et al. | 401/108 |
| 3,427,112 | 2/1969 | Yanagisawa et al. | 401/107 |

FOREIGN PATENT DOCUMENTS

| | | | |
|---|---|---|---|
| 1274927 | 8/1968 | Fed. Rep. of Germany | 401/107 |
| 4283 | 1/1983 | Japan . | |
| 464506 | 4/1937 | United Kingdom | 401/107 |

*Primary Examiner*—Steven A. Bratlie

*Attorney, Agent, or Firm*—Sughrue, Mion, Zinn, Macpeak & Seas

[57] ABSTRACT

A retractable fountain pen employs a cover plate rotatable about a supporting tube by means of a spring to sealingly contact the tapered front end of a cylindrical head portion to close off a central passageway therein. The tube prevents excess deformation of the resilient tapered front end portion.

9 Claims, 3 Drawing Figures

OPENING AND CLOSING DEVICE FOR RETRACTABLE NIB FOUNTAIN PEN

BACKGROUND OF THE INVENTION

This invention relates to an opening and closing device for the opening at the front end of a rectractable nib fountain pen.

Heretofore, it has been known to provide an elastic portion at the front end of a retractable fountain pen in order to prevent drying of ink at the pen point. A sealing effect is produced utilizing the elastic deformation of the elastic member at an abutment.

Japanese Utility Model Publn. No. 82/1967 are typical of such devices. The Japanese publication discloses that an elastic ring having a communicating hole communicating with a throughhole of the holder and a tapered front end at which the connunicating hole is opened is connected to the holder. A cover plate is usually biased towards the tapered front end by means of a spring action to close the communicating hole of the elastic ring. The elastic ring utilized has a cross secion of equal thickness throughtout and is of short length.

However, such a construction has, in practice, caused various problems. Namely, in retractable fountain pens, writing is effectuated by projecting the pen out from the holder. In this case, however, since the projecting of the pen is carried out by pushing the cover plate with the tip point of the pen, the strength of the spring is limited in order to prevent damage and deformation of the pen point. Accordingly, in order to prevent ink drying at the pen point by perfectly mating the cover plate against the elastic ring having the shape described above, it is inevitable that the elastic ring will be made of a material having sufficient elasticity. Alternatively, the thickness of the elastic ring itself will be reduced since the strength of the spring is limited as described above. In this case, however, when the elastic ring is prepared using a material having sufficient elasticity, since the elastic ring itself is of short length, it is liable to be deformed and would be strained. On the other hand, if the thickness of the elastic ring is reduced, buckling is produced due to excess bending at the abutment with the cover plate. Such a strain, or excessive bending or buckling, produces a partial gap between the elastic ring and the cover plate so that no effective seal is made, making it difficult to prevent the drying of ink at the pen point.

SUMMARY OF THE INVENTION

An object of the present invention is to remedy the above-mentioned problems and to provide an opening and closing device which prevents the drying of ink.

In this invention, in order to attain this object, and elastic head portion, having a communicating hole communicating with a through hole of a holder and a tapered front end in which the communicating hole opens is connected to the holder. A cover plate is biased towards the tapered front end by a spring means to close the communicating hole at the elastic head portion. The elastic head portion has a cylindrical shape, and the tapered front end is made thinner than the other parts of the elastic head portion.

By this construction, the elastic head portion becomes firm enough to avoid buckling when the cover plate is pressed thereagainst, and deformation at the attachment to the holder does not occur.

Another characteristic feature of the invention resides in that a cover supporting tube is affixed to the holder. The cover supporting tube has a tip end portion in contact with the upper surface of the elastic head portion, and a gap is formed between the portions other than the tip end portion and the upper surface of the elastic head portion. By this technique, excessive deformation of the tapered front end can be prevent due to the tip end of the cover supporting tube. Also, since the cover supporting tube is not in contact with the entirety of the upper surface of the elastic head portion, the elastic head portion will not be unnecessarily deformed upon the pressing of the cover plate. For this reason, the sealing effect is enhanced, and an excellent opening and closing device for presenting the drying of ink at the pen point can be obtained.

The inner and outer diameters of the elastic head portion used in this invention may be changed variously in the longitudinal direction. The shape thereof may be appropriately selected in compliance with the diameter, length and material of the elastic head portion. However, it is preferable to select a shape in which a flange is formed at the side opposite the tapered front end because the strain at the attachment of the holder can be greatly reduced. The tapered front end of the elastic end portion is made thinner than the other portions. Further, when the shape of the tapered front end surface is made convex, the sealing effect is improved because the contact area of the elastic head portion with the cover plate can be reduced even if a slight unevenness is found in the flatness of the contact surface between the cover plate and the tapered front end. As materials for forming the elastic head portion, NBR or urethane rubber can be used.

The cylindrical holder which couples the elastic head portion may either be a cylindrical member or a connecting cylinder connecting the elastic head portion to the cylindrical member.

The cover supporting tube to be attached to the cylindrical holder may preferable be a tapering cylinder, since the formation of the above-mentioned gap is thereby made simple. The tip end of the cover supporting tube can usually be in contact with the elastic head portion, but it may also be arranged so as to be contacted only when the elastic head portion is deformed, being pressed by the cover.

The sealing effect will be much improved when no looseness is found at the supporting point of the cover plate when it is bent or rotated. For this purpose, a preferable result is obtained when the cover plate is rotatably supported on the cover supporting tube.

The spring means maybe of a known construction, but it is preferable that the spring be coupled to both the cover plate and the cover supporting tube for stability in construction. For example, a favorable result is obtained when a coil spring is used, retained by the cover plate and the cover supporting tube.

When a cap is used which covers the opening and closing device and which is connected to the holder to protect the above-described opening and closing device, it is necessary to form a gap between the upper surface of the tapered front end and the inner surface of the cap so that there is no contact between these surfaces, for the purpose of ensuring an appropriate bending deformation of the tapered front end.

BRIEF DESCRIPTION OF THE DRAWINGS

The invention will now be described referring to one embodiment shown in the accompanying drawings; in which.

DETAILED DESCRIPTION OF THE PREFERRED EMBODIMENTS

Figure 1:
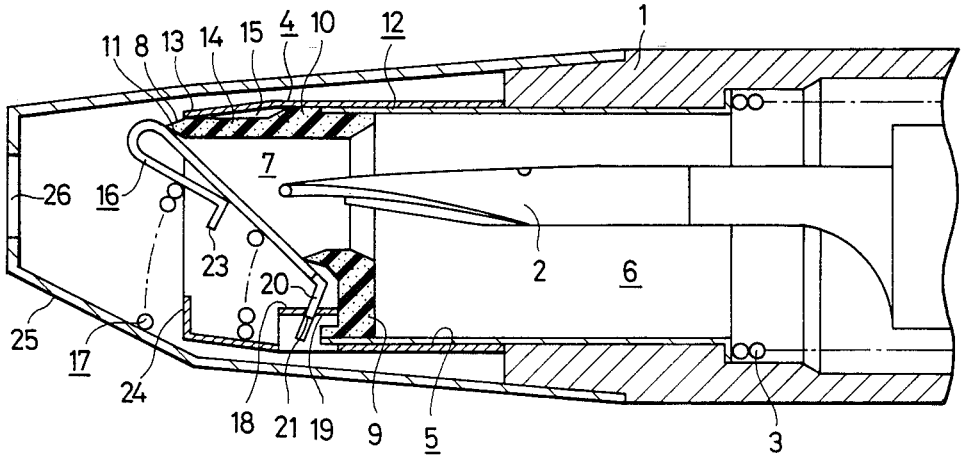
FIG. 1 is a partial cross section showing a fountain pen equipped with the device according to the present invention, wherein the pen point is accommodated in the holding cylinder.

Reference numeral 1 designates the front end opening of a plastic cylindrical holder, in which a pen 2 and a coiled spring 3 are accommodated, the latter serving to make the pen 2 retractable. A cylindrical elastic head portion 4 made of NBR is continuously connected to the front end opening 1 through a connecting cylinder 5 made of a metal. The throughhole 6 of the connecting cylinder 5 communicates with the communicating hole 7 of the elastic head portion. The front end 8 of the elastic head portion 4 is inclined with respect to the axial line at an angle of about 45°.

Figure 2:
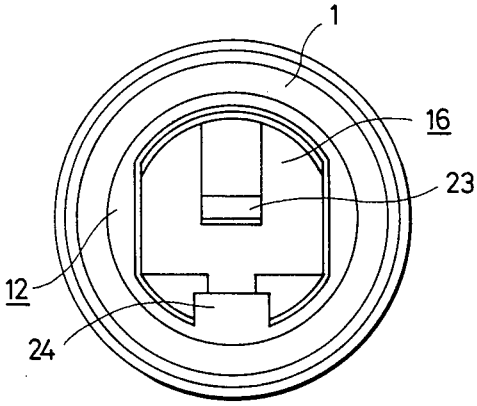
FIG. 2 is a side view wherein the cap and the coiled spring of the fountain pen are removed.
Figure 3:
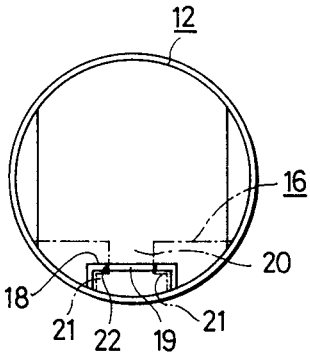
FIG. 3 is a side view showing the cover supporting tube from its connecting side.

The communicating hole 7 is opened at the tapered front end 8 of the head 4, and a flange 9 formed opposite the tapered front end 8 is fixed to the connecting cylinder 5. The thickness of the tapered front end 8 is made thinner than the portion 10 therebehind, and the front end surface 11 thereof has a convex shape as can be seen from FIG. 1. A cylindrical cover supporting tube 12 made of a metal and having a tapering front end is fitted on the connecting cylinder 5. The tip portion 13 of the cover supporting tube 12 is in contact with and continuous with the tapered front end surface 11, and is also in contact with the radially outer surface of the elastic head portion immediately therebehind. However, a gap 15 is formed between the tube 12 and the upper surface 14 of the elastic head portion 4 rearwardly of this location as is seen in FIG. 1. A metal cover plate 16 is supported by the cover plate supporting tube 12. The cover plate 16 is usually biased against the tapered front end 8 by means of a coil spring 17, which abuts the cover supporting tube 12 and the cover plate 16, for closing the communication hole 7 of the elastic head portion 4. More particularly, as is clear from FIGS. 1 and 3, to support the cover plate 16, a shelf portion 18 is provided at the lower portion of the cover supporting tube 12, and a notch 19 is formed in the surface of the shelf portion 18 from the direction of the front end opening 1. On the other hand, the cover plate 16 is formed with a neck portion 20 and a pair of shoulder portions 21, 22 extending from the lower part of the neck portion. When the neck portion 20 is inserted into the notch 19, the shoulder portions 21, 22 are held at the lower surfaces 22 of the shelf portion 18, and thus the cover plate 16 is supported. In order to support the coil spring 17, the upper end of the cover plate 16 is bent down toward the side opposite the elastic head portion 4, and again bent at the tip end portion thereof to form a projection 23, as shown in FIGS. 1 and 2. Another projection 24 is formed at the lower part at the open side of the cover supporting tube 12. The convex-shaped tapered front end surface 11, which is pressed by the cover plate 16 as shown in FIG. 1, is actually somewhat deformed. As is seen from FIG. 2, both sides of the cover plate 16 are in contact with the cover supporting tube 12, whereby lateral displacement is prevented. Reference numberal 25 indicates a metal cap having a window 26 for extension and retraction of the pen, and is fitted to the front end opening 1. A gap is formed between the inner surface of the cap 25 and the tapered front end 8.

When the cover plate 16 closes the tapered front end 8, the coil spring 17 joins the shoulders 21 and the shelf 18 of the cover supporting tube 12, and thus the cover plate 16 is supported by the cover supporting tube 12, so that the supporting point of rotation will not be deflected, and stable rotation is obtained. No strain is produced in the elastic head portion 4 pressed by the cover plate 16 because of its firmness, and the sealing effect is enhanced since the tapered front end surface 11 of the elastic head portion 4 has a convex shape in line-contact with the cover plate 16. No excessive or unnecessary deformation is produced at the tapered front end 8 due to the tip end portion 13 of the cover supporting tube 12 and the presence of the gap 15. Through the device of this invention, which functions as described above, drying of ink at the pen point can be perfectly prevented.

What is claimed is:

1. An opening and closing device for the front end of a retractable nib fountain pen, comprising;

a cylindrical holder;

a cylindrical elastic head portion having a communicating hole communicating with a throughhole of said holder, and a tapered front end in which said communicating hole opens, at least said tapered front end being made thinner in thickness than other portions of said elastic head portion;

a cover supporting tube having a tip portion at least partially surrounding an outer surface of said elastic head portion and including means limiting the amount of elastic deformation of said tapered front end;

a cover plate rotatably supported by said cover supporting tube and movable into and out of engagement with the tapered front end of the elastic head portion;

spring means biasing the cover plate against the tapered front end for closing the communicating hole in the elastic head portion;

wherein said means limiting the amount of elastic deformation of said tapered front end comprises an inwardly bent portion of said cover supporting tube having an end positioned at a point on said elastic head portion where said tapered front end terminates and said elastic head portion is of uniform thickness; and an annular cap surrounding said cover supporting tube and separated therefrom, said cap having an opening through which a nib of said fountain pen protrudes when said opening and closing device is opened.

2. An opening and closing device as claimed in claim 1, wherein said elastic head portion has a convex-shaped tapered front end surface.

3. An opening and closing device as claimed in claim 1, wherein said elastic head portion is provided with a flange at the side thereof opposite the tapered front end.

4. An opening and closing device as claimed in claim 1, wherein said cover supporting tube is a cylinder, the diameter of which gradually decreases towards the tip portion thereof.

5. An opening and closing device as claimed in claim 3, wherein said flange is substantially thicker than said tapered end portion, said holder being coupled to said flange portion.

6. An opening and closing device as claimed in claim 1, wherein said spring means comprises a coil spring held by said cover supporting tube and said cover plate.

7. An opening and closing device as claimed in claim 1, wherein a gap is formed between said cover supporting tube and said elastic head portion at portions thereof rearward of said tip portion thereof.

8. An opening and closing device as claimed in claim 6, said cover supporting tube including means for pivotably supporting said cover plate, and said tube and said cover plate each including spring supporting portions.

9. An opening and closing device as claimed in claim 1, said tip portion contacting said tapered front end over a portion of the length thereof.

* * * * *